US006718845B2

(12) United States Patent
Menzies

(10) Patent No.: US 6,718,845 B2
(45) Date of Patent: Apr. 13, 2004

(54) PEDAL ASSEMBLY WITH RADIALLY OVERLYING SENSOR AND HYSTERESIS

(75) Inventor: Brad C. Menzies, Flint, MI (US)

(73) Assignee: Teleflex Incorporated, Plymouth Meeting, PA (US)

( * ) Notice: Subject to any disclaimer, the term of this patent is extended or adjusted under 35 U.S.C. 154(b) by 64 days.

(21) Appl. No.: 09/974,667

(22) Filed: Oct. 9, 2001

(65) Prior Publication Data

US 2003/0066375 A1 Apr. 10, 2003

(51) Int. Cl.[7] ..... G05G 1/14

(52) U.S. Cl. ..... 74/512; 74/560; 188/325

(58) Field of Search ..... 74/512, 513, 514, 74/560; 192/75, 76; 188/78, 325, 334, 342

(56) References Cited

U.S. PATENT DOCUMENTS

| | | | | | |
|---|---|---|---|---|---|
| 2,111,755 | A | * | 3/1938 | Compton | 188/106 A |
| 4,958,607 | A | | 9/1990 | Lundberg | 123/399 |
| RE34,302 | E | * | 7/1993 | Imoehl | 123/399 |
| 5,241,936 | A | * | 9/1993 | Byler et al. | 123/399 |
| 5,295,409 | A | * | 3/1994 | Byram et al. | 74/514 |
| RE34,574 | E | * | 4/1994 | Imoehl | 123/399 |
| 5,385,068 | A | * | 1/1995 | White et al. | 74/512 |
| 5,408,899 | A | | 4/1995 | Stewart | 74/513 |
| 5,529,296 | A | | 6/1996 | Kato et al. | 267/155 |
| 5,551,317 | A | | 9/1996 | Gautier et al. | 74/560 |
| 5,768,946 | A | * | 6/1998 | Fromer et al. | 74/514 |
| 5,865,067 | A | | 2/1999 | Knapp | 74/512 |
| 5,868,039 | A | | 2/1999 | Baumann | 74/512 |
| 5,868,040 | A | | 2/1999 | Papenhagen et al. | 74/513 |
| 5,934,152 | A | | 8/1999 | Aschoff et al. | 74/513 |
| 6,003,404 | A | | 12/1999 | Hannewald | 74/512 |
| 6,070,490 | A | | 6/2000 | Aschoff et al. | 74/513 |
| 6,147,590 | A | * | 11/2000 | Mikolcic | 338/153 |
| 6,164,155 | A | * | 12/2000 | Tonissen et al. | 74/514 |
| 6,220,222 | B1 | | 4/2001 | Kalsi | 123/399 |
| 6,330,838 | B1 | * | 12/2001 | Kalsi | 74/514 |
| 6,401,566 | B1 | * | 6/2002 | Beale et al. | 74/512 |
| 6,460,429 | B1 | * | 10/2002 | Staker | 74/513 |
| 6,470,768 | B2 | * | 10/2002 | Kato et al. | 74/513 |
| 6,474,191 | B1 | * | 11/2002 | Campbell | 74/514 |

FOREIGN PATENT DOCUMENTS

| | | |
|---|---|---|
| DE | 4407005 | 3/1995 |
| DE | 29611890 | 10/1996 |
| DE | 19521821 | 12/1996 |
| DE | 19612830 | 7/1997 |
| EP | 0818666 | 1/1998 |
| EP | 1055913 | 11/2000 |

* cited by examiner

*Primary Examiner*—Chong H. Kim
(74) *Attorney, Agent, or Firm*—Howard & Howard

(57) ABSTRACT

A brake cover (18) and shaft (24) rotate with a pedal lever (20) relative to a central section (14) of the housing (12) rotate a pedal gear (76). The pedal gear (76) rotates a sensor gear (74) to rotate a sensor arm (46) about a sensor axis (48). The sensor arm (46) supports sensor members (58) that move along sensor bands (50) to generate an electrical signal. As the brake cover (18) rotates with the pedal lever (20) it uncoils coil springs (84) to cause brake shoes (80) to pivot radially outward about respective posts (82) frictionally engage the interior surface (78) of the central section (14) to thereby provide a resistance or hysteresis to movement of the pedal lever (20). One feature resides in at least two elements (74, 76) to interconnect the sensor arm (46) and the pedal arm (20) to reduce space while maintaining the requisite movement of the sensor members (58) over the sensor bands (50) and the other feature resides in spacing the braking mechanism axially from the sensor arm (46) in radially overlapping relationship to one another along the pedal axis (A).

10 Claims, 6 Drawing Sheets

PEDAL ASSEMBLY WITH RADIALLY OVERLYING SENSOR AND HYSTERESIS

RELATED APPLICATION

This application discloses the same embodiment of a pedal assembly as co-pending Ser. No. 09/974,156 filed concurrently herewith but claims a different patentable feature of that embodiment.

BACKGROUND OF THE INVENTION

1. Field of the Invention

The subject invention relates to a pedal assembly with a sensor that generates an electric signal for controlling a vehicle system and a hysteresis mechanism for resisting movement of the pedal.

2. Description of the Prior Art

Pedal assemblies for controlling the throttle, clutch and braking systems in automotive vehicles have recently replaced mechanical linkage mechanisms with electrical sensors to generate electrical signals indicative of the degree of movement of the pedal to control the vehicle system. When electrical generators are used, it becomes necessary to build in a resistance to the movement of the pedal, such resistance being known as hysteresis. Besides cost and performance criteria, it is essential that the assembly occupy a minimum of space, as space within a vehicle is limited and is in demand for various uses.

In a recent assembly shown in U.S. Pat. No. 6,220,222 in the name of Kalsi and assigned to the assignee of the subject application, the pedal lever rotates a sensor arm that supports sensor members and circular sensor bands are supported by the housing to co-act with the sensor members to produce and electrical signal. The sensor arm extends radially from the pivot axis of the pedal arm and the hysteresis mechanism is disposed yet radially farther from the pedal lever pivot axis than the distal end of the sensor arm. As a result, the components of the assembly are stacked one on top of another in the radial direction.

SUMMARY OF THE INVENTION AND ADVANTAGES

The invention provides a pedal assembly for electronically controlling a vehicle and includes a housing having opposite sides and supports a pedal lever for pivotal movement about a pedal axis extending between the housing sides. A sensor arm is movably supported by the housing and at least one sensing band is supported by the housing while at least one sensor member is supported by the sensor arm for movement with the sensor arm and co-acting with the sensing band. A braking mechanism provides resistance to movement of the pedal lever about the pedal axis. The assembly is characterized by the sensor arm and the braking mechanism being axially spaced along the pedal axis and disposed in radially overlapping relationship to one another.

As the braking mechanism and the sensor arm extend radially in the same radial space, instead of being radially stacked, the radial extent of the housing can be reduced to a minimum. This association of components allows for the minimum use of space for the housing that contains both the sensor arm and the braking mechanism.

BRIEF DESCRIPTION OF THE DRAWINGS

Other advantages of the present invention will be readily appreciated as the same becomes better understood by reference to the following detailed description when considered in connection with the accompanying drawings wherein:

FIG. 5 is a perspective view from the brake cover side and partially cut away and in cross section of the preferred embodiment; and.

DETAILED DESCRIPTION OF THE PREFERRED EMBODIMENT

Figure 1:
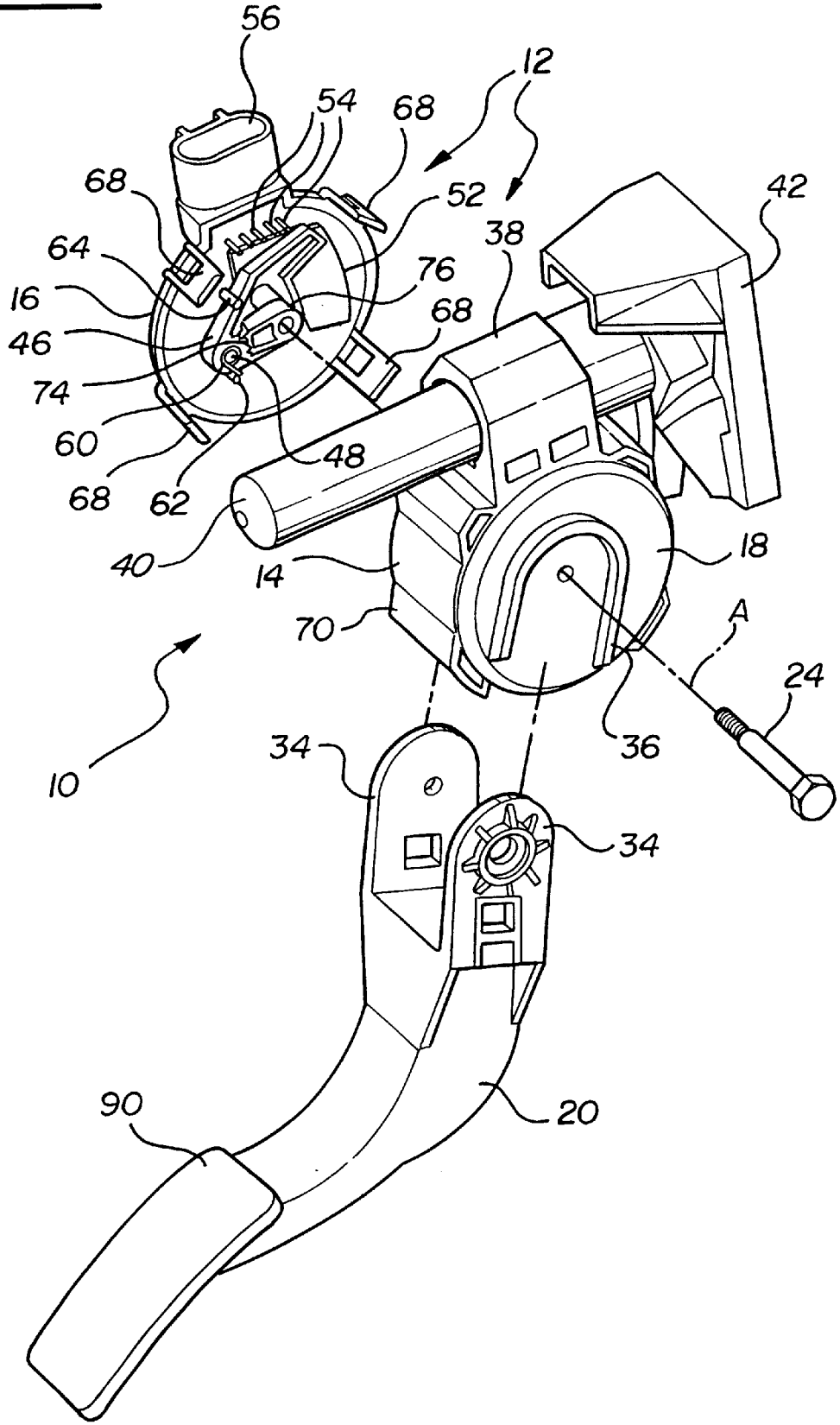
FIG. 1 is an exploded-perspective view from the brake cover side of the preferred embodiment.
Figure 2:
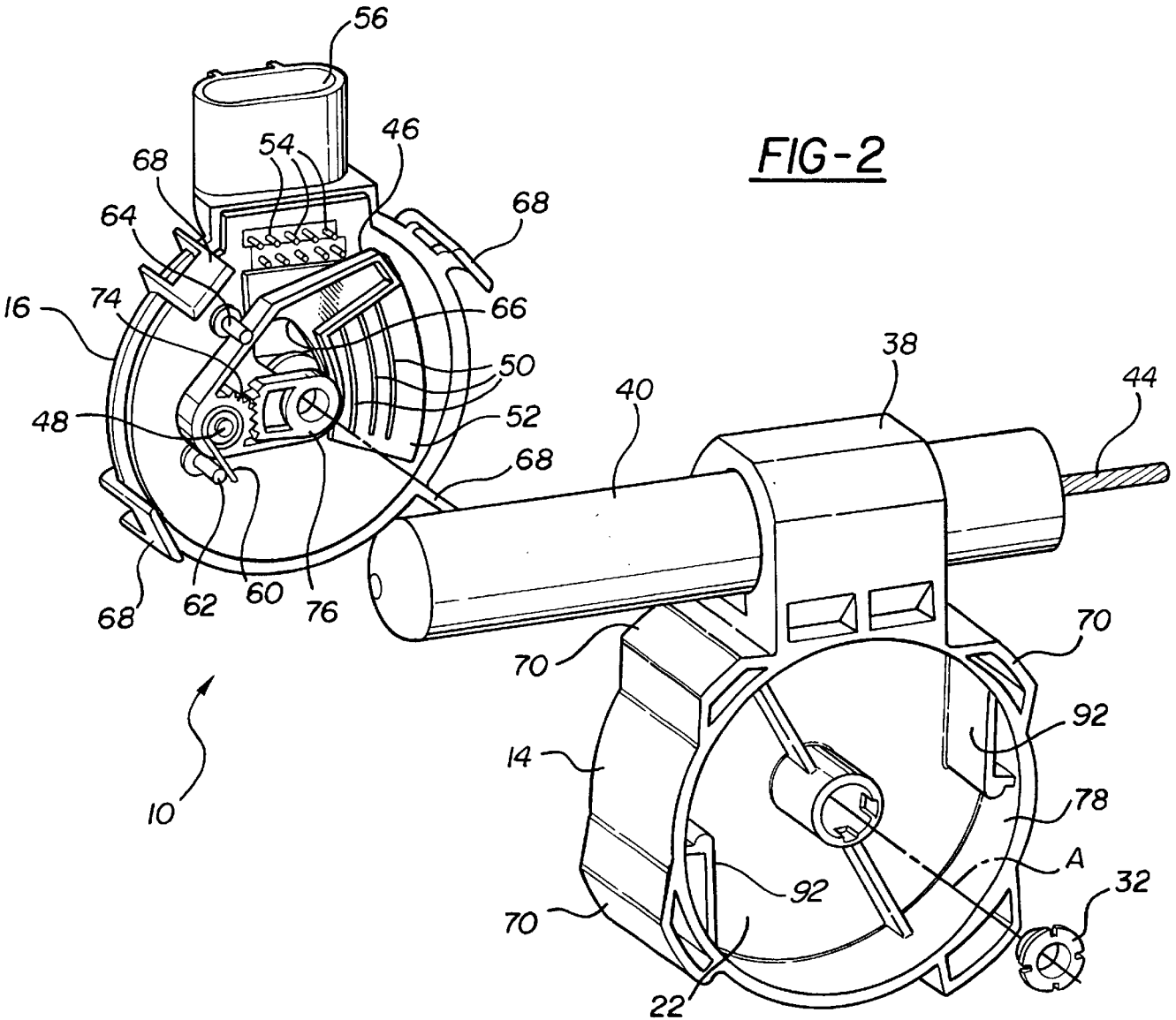
FIG. 2 is an exploded perspective view of the housing and the sensor cover of the preferred embodiment.
Figure 3:
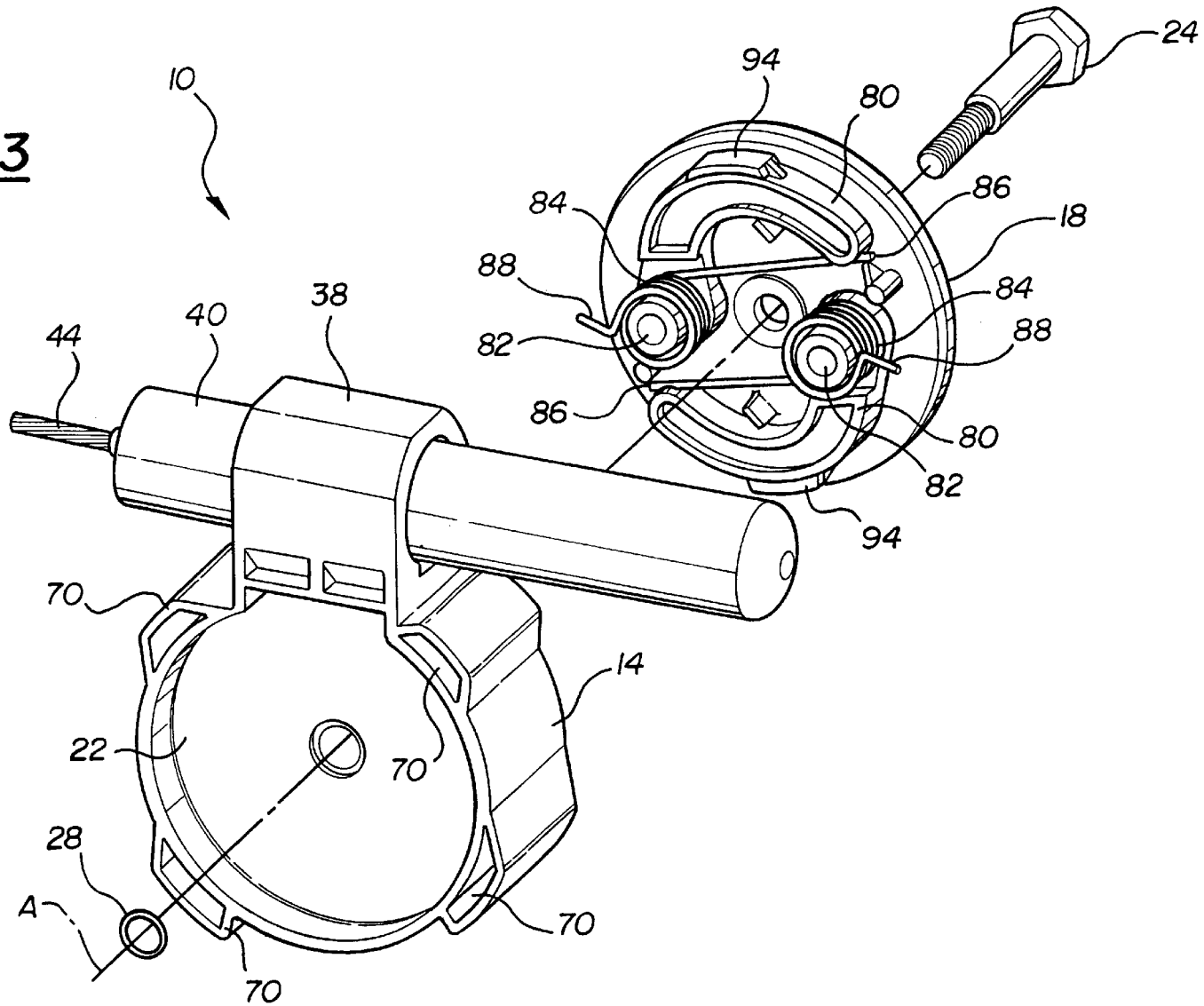
FIG. 3 is an exploded perspective view of the housing and the brake cover of the preferred embodiment.
Figure 4:
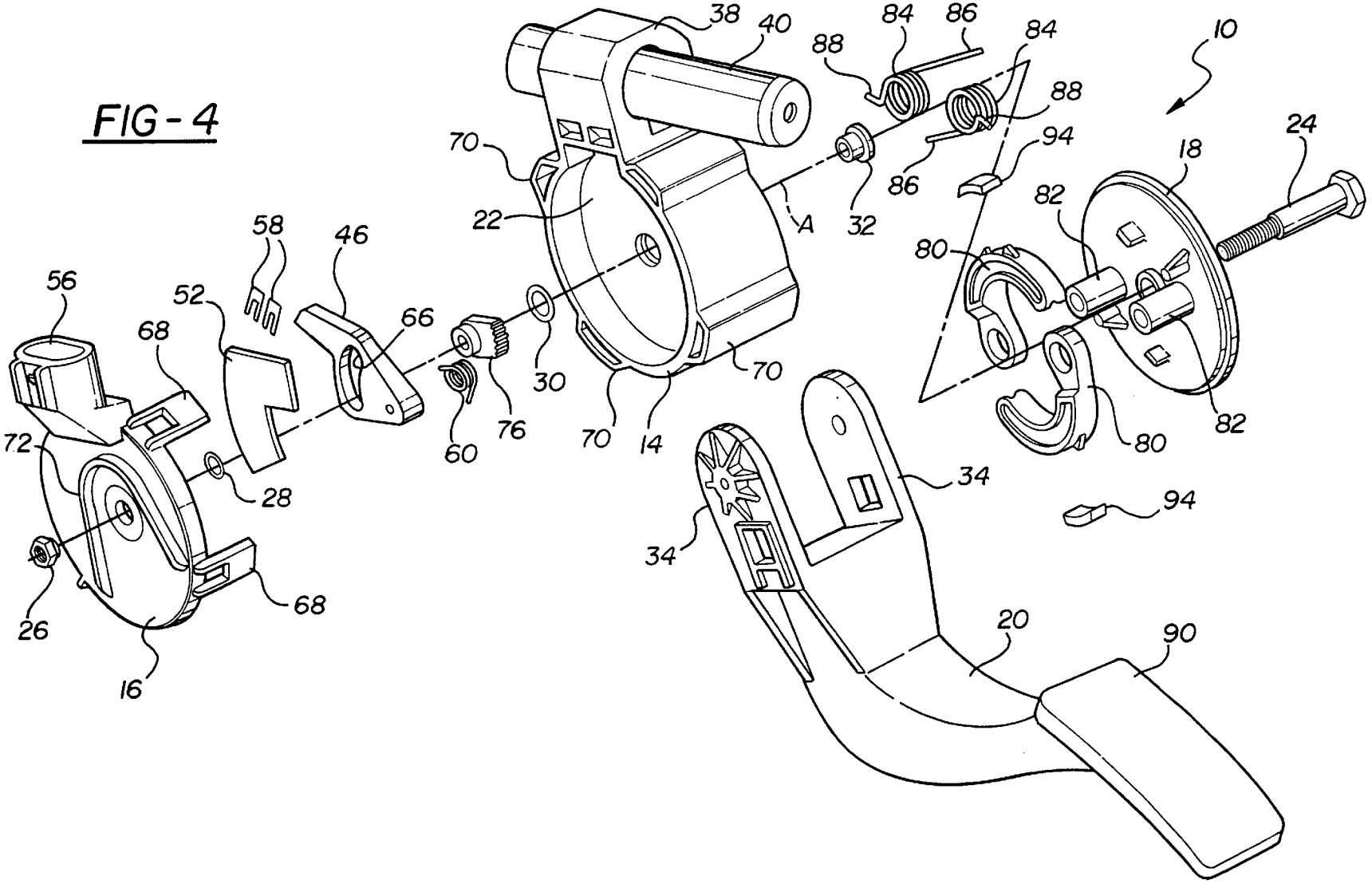
FIG. 4 is an exploded-perspective view from the sensor cover side of the preferred embodiment.
Figure 5:
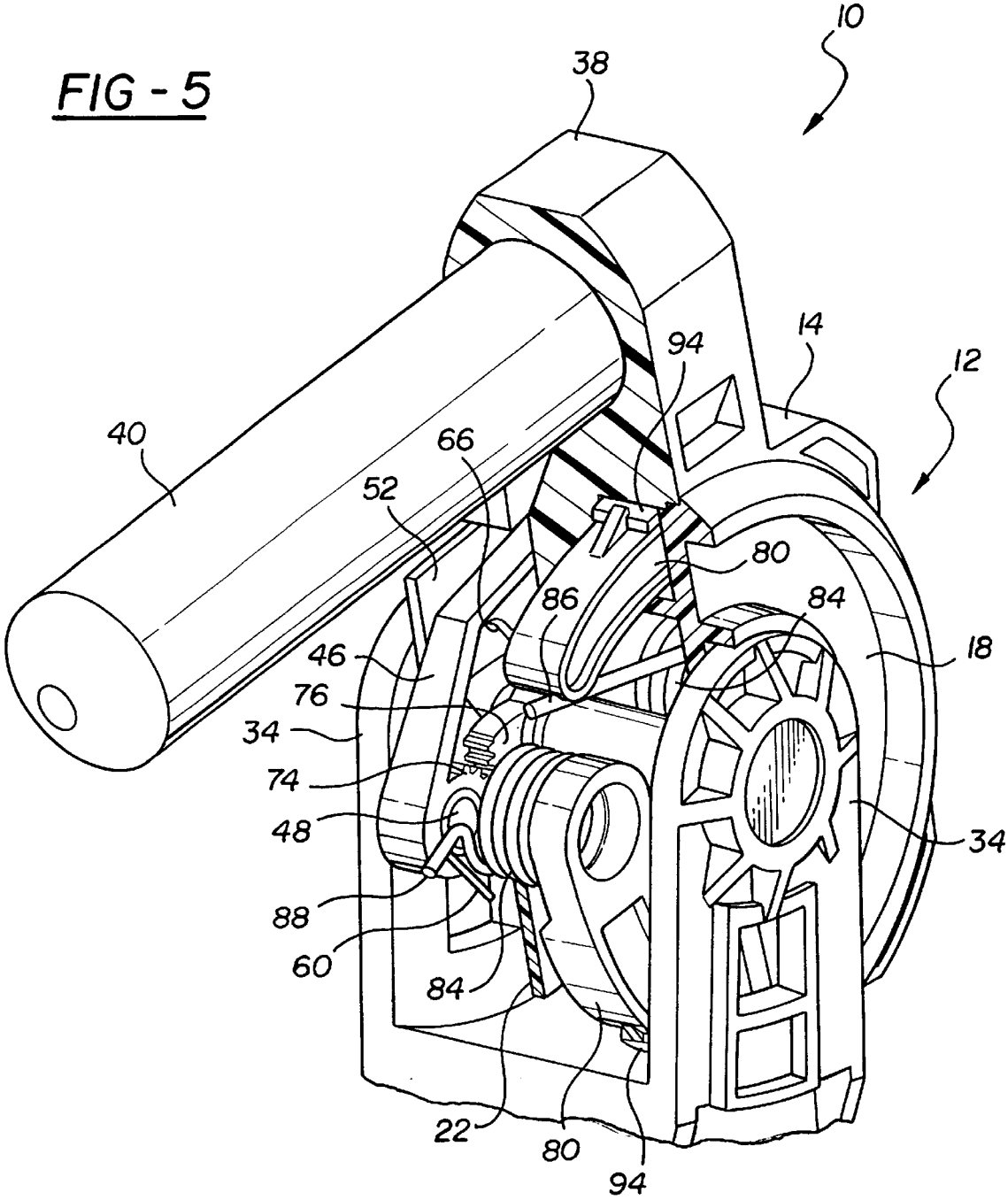
Figure 6:
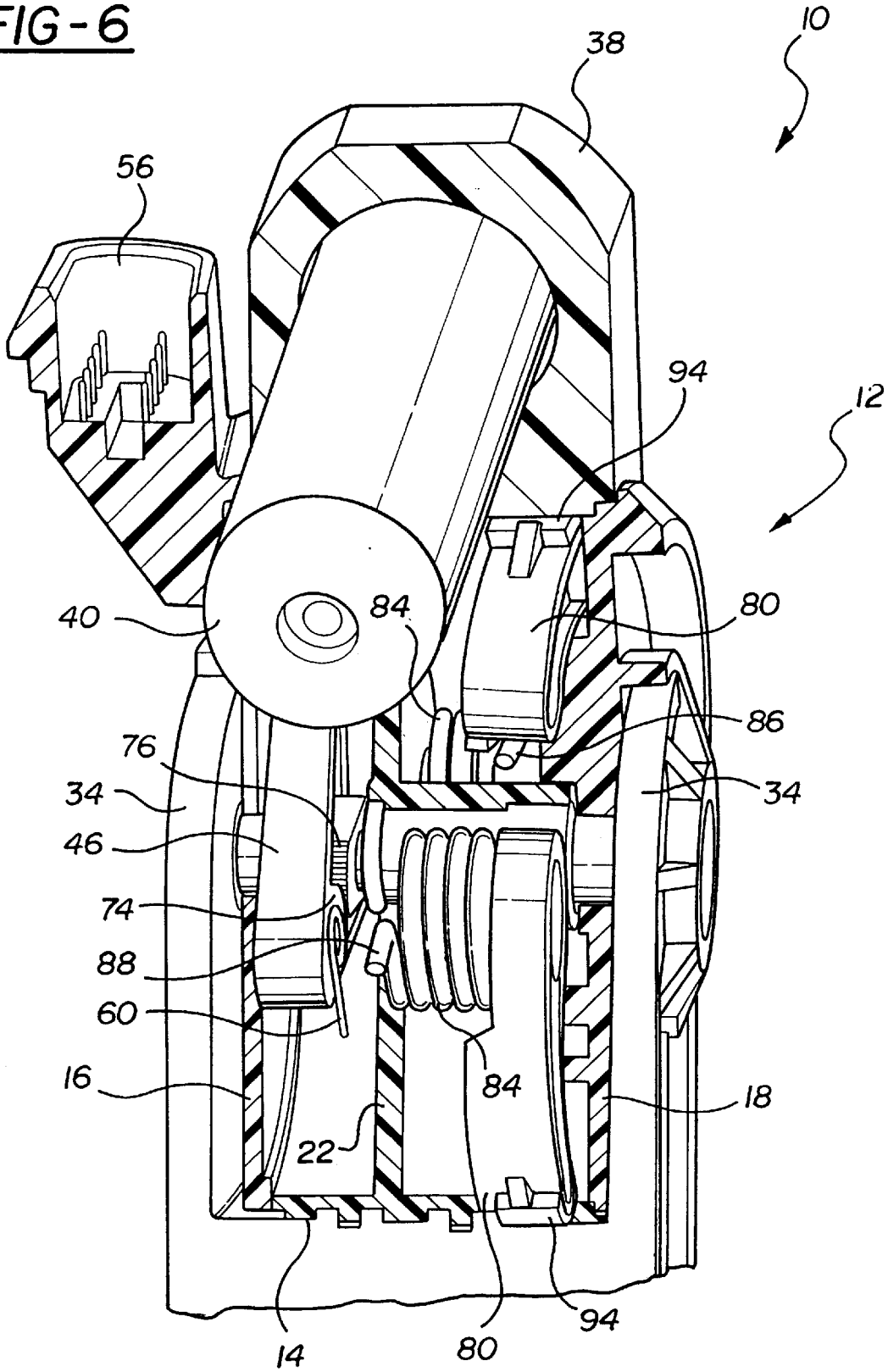
FIG. 6 is a perspective view from the front and partially cut away and in cross section of the preferred embodiment.

Referring to the Figures, wherein like numerals indicate like or corresponding parts throughout the several views, a pedal assembly for electronically controlling a vehicle is generally shown at 10.

The assembly 10 includes a housing, generally shown at 12, having opposite sides. The housing 12 includes a central drum section 14 extending between open first and second ends. A sensor cover 16 closes the first end to define one of the housing sides and a brake cover 18 closes the second end to define the other housing side.

A pedal lever 20 is supported by the housing 12 for pivotal movement about a pedal axis (A) extending between the sides, i.e., between the covers 16 and 18.

The central section 14 of the housing 12 includes a center partition 22 and a shaft 24 extends through the covers 16 and 18 and the partition 22. The shaft 24 comprises a bolt and nut 26 that also support the o-ring seals 28 and 30 and the bushing 32. Alternatively, the shaft may be a press fit pin with snap-in bushings replacing the nut 26 and bushing 32. The pedal lever 20 has a forked end with two tongs 34 and the covers 16 and 18 of the housing 12 are disposed between the tongs 34 with the tongs 34 secured to the shaft 24 and the brake cover 18 for rotation therewith. The brake cover 18 includes a rib 36 to define a stop or mechanical connection engaging one tong of the pedal lever 20 so that the brake cover 18 rotates relative to the central section 14 of the remainder of the housing 12.

The central section 14 of the housing 12 includes a carrier section 38 slidably supported on a guide rod 40 for adjusting the operative positions of the pedal assembly 10 for accommodating vehicle operators having different leg lengths. The rod 40 is supported by a bracket 42 adapted to be mounted on a vehicle structure and the guide section 38 is moved rectilinearly along the guide rod 40 between various adjusted positions by a screw 44, as is well known in the art and exemplified by the disclosure in U.S. Pat. No. 5,964,125.

The sensor cover 16 of the housing 12 movably supports a sensor arm 46. More specifically, the sensor arm 46 is pivotally supported by the sensor cover 16 for pivotal movement about a sensor axis defined by a pin 48 extending integrally from the sensor cover 16. The sensor axis of the pin 48 is spaced from the pedal axis (A) and disposed on one diametrical side of the pedal axis (A) with the sensor arm 46 extending to the opposite diametrical side of the pedal axis (A).

A plurality of the sensing bands 50 are supported on the sensor cover 16 of the housing 12 via a plate 52 and the bands 50 disposed arcuately (circular segments) at different radial distances from the sensor axis of the pin 48. The sensor bands 50 are in electrical contact with electrical pins 54 which are in electrical communication with the electrical connector 56 that connects to the vehicle system. A plurality of sensor members 58 are supported on the sensor arm 46 at the different radial distances form the sensor axis 48 and each of the sensor members 58 is paired with one of the sensor bands 50.

A coil spring defines a biasing device 60 for applying a biasing force to the sensor arm 46 for urging the sensor arm 46 to rotate about the sensor axis of the pin 48. The spring 60 reacts between the sensor arm 46 and an abutment pin 62 extending from the sensor cover 16. Also included is a stop 64 to limit rotary movement of the sensor arm 46 about the sensor axis 48 in response to the biasing force applied by the biasing device 60. In order to accommodate movement of the sensor arm 46 and the sensor member 58 radially through the pedal axis (A), the sensor arm 46 includes an opening 66 and the pedal axis (A) is disposed in the opening 66. Accordingly, the sensor bands 50 and the sensor members 58 are disposed on the opposite diametrical side of the pedal axis (A) from the sensor axis.48.

The sensor cover 16 is prevented from rotating relative to the central section 14 of the housing 12 by tabs 68 that snap into pockets 70 in the central section 14. In addition, the sensor cover 16 includes an external ridge 72 that accommodates pivotal movement of the pedal lever 20 relative to the sensor cover 16.

The assembly is characterized by a mechanism of at least two elements movable relative to one another and interconnecting the pedal lever 20 and the sensor arm 46 for moving the sensor arm 46 in response to movement of the pedal lever 20. More specifically, one of the elements comprises a gear sector or sensor gear 74 and the other element comprises a pedal gear 76 rotatable by the pedal lever 20 through the shaft 24 about the pedal axis (A). The sensor gear 74 is disposed in the opening 66 of the sensor arm 46 and is in meshing engagement with the pedal gear 76 whereby the sensor gear 74 is rotatable by the pedal gear 76 for rotating the sensor arm 46 about the sensor axis 48. As alluded to above, the pedal axis (A) is disposed in the opening 66 in the sensor arm 46 to accommodate movement of the sensor arm 46 and the sensor member 58 radially through the pedal axis (A), i.e., the sensor members 58 are on a radial extending from the sensor axis 48 and which moves in an arc back and forth to either side of the pedal axis (A). In accordance with the invention, the pedal gear may drive a rack rectilinearly instead of in an arc. In any case, by employing two or more elements interconnecting the pedal lever 20 and the sensor arm 46, whether it moves in an arc or linearly, the requisite degree of movement of the sensor members 58 may be attained while minimizing the distance occupied between the pedal axis (A) and the sensor bands 50.

The assembly 10 also includes a braking mechanism supported by the brake cover 18 for providing resistance to movement of the pedal lever 20 about the pedal axis (A).

The assembly is also characterized by the sensor arm 46 and the braking mechanism being axially spaced from one another along the pedal axis (A) and disposed in radially overlapping relationship to one another. Such a combination also provides a compact pedal assembly 10.

The central section 14 of the housing 12 includes a inner cylindrical surface 78 a pair of brake shoes 80 are movably supported by the brake cover 18 of the housing 12 for movement radially outwardly into engagement with the cylindrical surface 78 for providing resistance to movement of the pedal lever 20. A pair of posts 82 extend axially from the inside of the brake cover 18 of the housing 12 and each of the brake shoes 80 extends arcuately from a pivot end pivotally supported by one of the posts 82 to a distal end. A brake actuator comprising a biasing coil spring 84 interconnecting each brake shoe 80 and the housing 12 for moving the brake shoe 80 into engagement with the inner cylindrical surface 78 in response to pivotal movement of the pedal lever 20 in a first direction, that is, as force is applied to the pedal pad 90 supported on the lower end of the pedal lever 20. Each coil spring 84 has a central coil disposed about one of the posts 82 with a first end 86 extending from the coil and engaging the distal end of the adjacent brake shoe 80 supported by that same post 82 and a second end 88 extending from the coil and engaging a shoulder 92 extending from the inner cylindrical surface 78 of the central section 14 of the housing 12. Each of the brake shoes 80 includes a brake pad 94 for frictional engaging the inner cylindrical surface 78.

As alluded to above, the brake cover 18 is rotatable with the pedal lever 20 relative to the central section 14 of the housing 12 as it rotates in response to an operator force applied to the pedal pad 90, the shaft 24 rotates to rotate the pedal gear 76. The pedal gear 76 rotates the sensor gear 74 to, in turn, rotate or pivot the sensor arm 46 about the sensor axis 48. As the sensor arm 46 moves in an arc, the sensor members 58 move along the sensor bands 50 to generate an electrical signal that is transmitted to the vehicle control system. At the same time or simultaneously, because of the mechanical driving connection provided by the rib 36 co-acting with one tong 34 of the pedal lever 20, the brake cover 18 rotates with the pedal lever 20 to uncoil the coil springs 84 as they react with the shoulders 92 of the central section 14 of the housing 12. The uncoiling action of the springs 84 cause the brake shoes 80 to pivot radially outward about the respective posts 82 so that the brake pads 94 frictionally engage the interior surface 78 of the central section 14 to thereby provide a resistance or hysteresis to movement of the pedal lever 20.

Obviously, many modifications and variations of the present invention are possible in light of the above teachings. For example, it is clear that the feature of utilizing at least two elements in a mechanism to interconnect the sensor arm and the pedal arm to reduce space while maintaining the requisite movement of the sensor members over the sensor bands may be used independently of the feature of spacing the braking mechanism axially from the sensor arm along the pedal axis (A) and disposed in radially overlapping relationship to one another. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

Glossary of Terms by Reference Numeral pedal assembly 10
housing 12 central section 14
sensor cover 16
brake cover 18
pedal lever 20
partition 22
shaft 24
nut 26
o-ring seals 28 and 30
bushing 32
tongs 34
rib 36
carrier section 38
rod 40
bracket 42
screw 44
sensor arm 46
pin 48
sensing bands 50
plate 52
electrical pins 54
electrical connector 56
sensor members 58
biasing device 60
abutment pin 62
stop 64
opening 66
tabs 68
pockets 70
ridge 72
sensor gear 74
pedal gear 76
cylindrical surface 78
brake shoes 80
posts 82
coiled springs 84
first end 86
second end 88
pedal pad 90
shoulders 92
brake pad 94

What is claimed is:

1. A pedal assembly for electronically controlling a vehicle comprising;

a housing having a central section extending between open first and second ends with an inner curved surface, a sensor cover closing said first end, a brake cover closing said second end, a pedal lever supported by said central section of said housing for pivotal movement about a pedal axis extending between said covers, a sensor arm movably supported on said sensor cover inside of said first end of said housing, at least one sensing band supported on said sensor cover inside of said first end of said housing, at least one sensor member supported by said sensor arm for movement with said sensor arm and co-acting with said sensing band, and at least one brake shoe movably supported on said brake cover for movement radially outwardly into engagement with said curved surface for providing resistance to movement of said pedal lever about said pedal axis and a post directly interconnecting said brake cover and said brake shoe for directly supporting said brake shoe on said brake cover.

2. An assembly as set forth in claim 1 including a brake actuator interconnecting said brake shoe and said housing for moving said brake shoe into engagement with said inner curved surface in response to pivotal movement of said pedal lever in a first direction.

3. An assembly as set forth in claim 2 wherein said brake actuator includes a biasing spring reacting between said brake cover and said brake shoe.

4. An assembly as set forth in claim 3 wherein said biasing spring comprises a coil spring having a central coil with a first end extending from said coil and engaging said brake shoe and a second end extending from said coil and engaging said brake cover.

5. An assembly as set forth in claim 4 including a pair of said brake shoes, each of said brake shoes extending arcuately to a distal end from a pivot end pivotally supported by said brake cover.

6. An assembly as set forth in claim 5 wherein said brake cover includes one of said post supporting each of said pivot ends of said brake shoes.

7. An assembly as set forth in claim 6 including one of said biasing springs at each of said posts with said distal end of each spring engaging said distal end of the adjacent brake shoe.

8. An assembly as set forth in claim 7 wherein each of said brake shoes includes a pad for frictional engaging inner curved surface.

9. An assembly as set forth in claim 7 including a center partition in said central section, a shaft extending through said covers and said partition, said pedal lever having a forked end with two tongs, said covers of said housing being disposed between said tongs with said tongs secured to said shaft and said brake cover for rotation therewith.

10. An assembly as set forth in claim 9 wherein said sensor arm is pivotally supported by said sensor cover for pivotal movement about a sensor axis.

* * * * *